US007063594B1

(12) United States Patent
Engin et al.

(10) Patent No.: US 7,063,594 B1
(45) Date of Patent: Jun. 20, 2006

(54) CUTTING EDGE HONING PROCESS

(75) Inventors: Serafettin Engin, St. Lambert (CA); Martin Lavoie, Terrebonne (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 11/045,359

(22) Filed: Jan. 31, 2005

(51) Int. Cl.
*B24B 1/00* (2006.01)

(52) U.S. Cl. ..... 451/36; 451/104; 451/113

(58) Field of Classification Search ..... 451/104, 451/106, 113, 326, 327, 328, 5, 6, 41, 36
See application file for complete search history.

(56) References Cited

U.S. PATENT DOCUMENTS

| | | | | |
|---|---|---|---|---|
| 2,497,021 | A | 2/1950 | Stems | |
| 2,947,124 | A | 8/1960 | Madigan et al. | |
| 3,044,219 | A | 7/1962 | Cutler | |
| 3,147,572 | A | 9/1964 | Kempe | |
| 3,599,374 | A | 8/1971 | Porter et al. | |
| 3,623,278 | A | 11/1971 | Schwartz | |
| 4,122,603 | A | 10/1978 | Sastri | |
| 4,280,302 | A | 7/1981 | Ohno | |
| 4,615,145 | A | 10/1986 | Matsumoto et al. | |
| 4,771,659 | A | 9/1988 | Schmolke | |
| 5,125,191 | A | 6/1992 | Rhoades | |
| 5,251,409 | A * | 10/1993 | Orbank | 451/37 |
| 5,341,602 | A | 8/1994 | Foley | |
| 5,709,587 | A | 1/1998 | Shaffer | |
| 5,762,538 | A | 6/1998 | Shaffer | |
| 5,785,586 | A | 7/1998 | Delsignore | |
| 5,829,131 | A | 11/1998 | DeSloover et al. | |
| 5,944,587 | A | 8/1999 | Stadtfeld | |
| 6,261,154 | B1 * | 7/2001 | McEneny | 451/32 |
| 6,544,110 | B1 | 4/2003 | Gilmore et al. | |
| 6,547,495 | B1 * | 4/2003 | Meece et al. | 408/1 R |
| 6,764,384 | B1 * | 7/2004 | Kleer et al. | 451/32 |

* cited by examiner

*Primary Examiner*—Lee D. Wilson
*Assistant Examiner*—Anthony Ojini
(74) *Attorney, Agent, or Firm*—Ogilvy Renault LLP

(57) ABSTRACT

A method of honing a cutting edge of a rotary cutting tool comprising inserting the cutting tool into a liquid bath having an abrasive media therein such that at least the cutting edges are immersed, and providing a relative displacement of the cutting tool and the liquid bath such that the abrasive media flows over the cutting edges.

17 Claims, 5 Drawing Sheets

CUTTING EDGE HONING PROCESS

TECHNICAL FIELD

The invention relates generally to a tool sharpening technique and, more particularly, to an improved process for honing edges of a cutting tool.

BACKGROUND OF THE ART

Cutting edge honing is the process of slightly rounding off the cutting edges of a cutting tool or tool bit. Newly ground cutting tools often have cutting edges that are very sharp, which tend to rapidly wear and/or weaken at the tips leading to breaking of the tool. Thus, the cutting edges are "honed" or slightly rounded off by creating a rounded edge having a very small radius on the cutting edges, such that these problems are reduced and greater stability of the tool at low rotation speeds is enabled, without significantly reducing the effectiveness of the cutting tool.

Known cutting edge honing methods include: extrude honing, in which a putty loaded with granular abrasive is used; Burlytic™ systems, an electro-chemical deburring method using a power source and an electrolyte solution; and brushing and tumbling techniques. However, disadvantages exits with these known honing methods. Most of these methods are either time consuming and expensive, difficult to perform and control, or fail to ensure consistent and repeatable results resulting in cutting edges which are not evenly smooth.

Accordingly, an improved cutting edge honing process is desired.

SUMMARY OF THE INVENTION

It is therefore an object of this invention to provide an improved cutting edge honing process.

In a first aspect, the present invention provides a method of honing cutting edges of a rotary cutting tool comprising: inserting the cutting tool into a liquid bath having an abrasive media therein such that at least the cutting edges are immersed; and providing a relative displacement of the cutting tool and the liquid bath such that the abrasive media flows over the cutting edges.

In a second aspect, the present invention provides a cutting tool honing system comprising: a liquid bath within which a cutting tool is receivable, the bath including an abrasive granular media therein; and a cutting tool holder adapted for engaging the cutting tool, the cutting tool holder being operable to rotate the cutting tool about a central axis thereof and to displace the cutting tool within the bath, wherein a flow of the abrasive granular media relative to cutting edges of the cutting tool hones said cutting edges.

In a third aspect, the present invention provides a cutting edge honing process comprising: providing a cutting tool having at least one cutting edge; inserting the cutting tool into a liquid abrasive media bath such that at least the cutting edge is immersed; rotating the cutting tool within the abrasive media bath; and providing a relative displacement of the cutting tool and the liquid abrasive media bath flow.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1B:
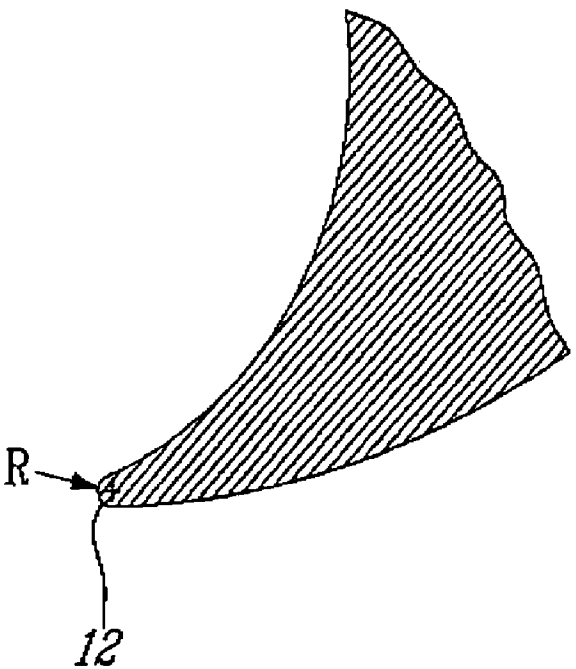
FIG. 1*b* is a detailed view of a cutting edge of the cutting tool of FIG. 1*a;*
Figure 1A:
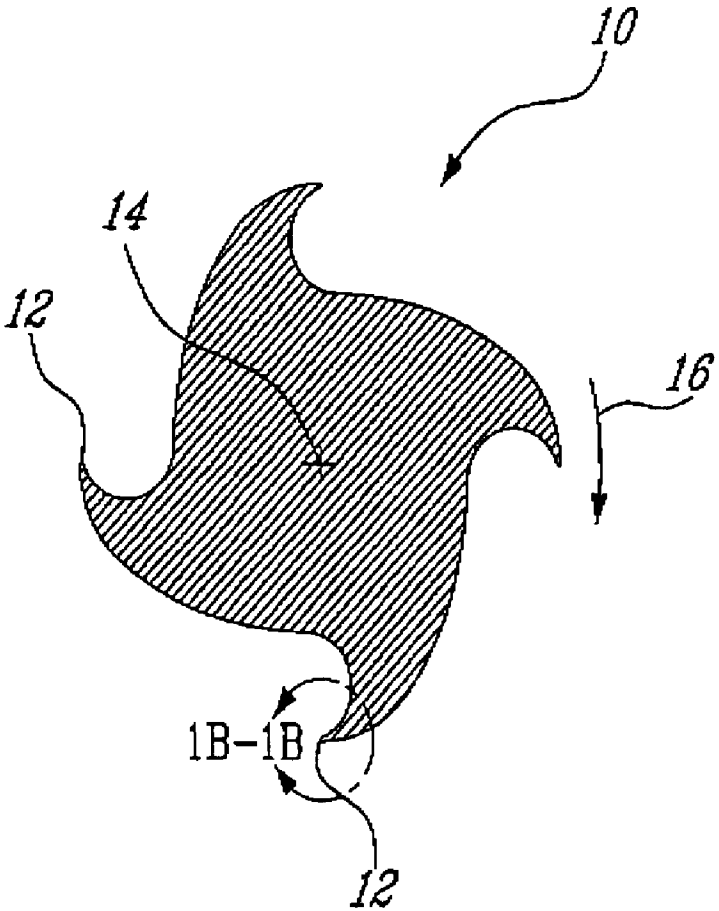
FIG. 1*a* is a cross-section of a cutting tool.

Referring to FIGS. 1*a* and 1*b*, a cutting tool 10 of the rotary variety includes several cutting edges 12 which extend at least along a portion of its longitudinal length. The cutting edges 12 may define a helical path along the cutting tool 10. The rotary cutting tool 10 has a longitudinal central axis 14 about which the tool is rotatable in a cutting direction 16 when in use to remove material from a workpiece. When such cutting tools are newly ground, the cutting edges 12 are very sharp. As described above, newly ground cutting edges tend to rapidly wear and easily break due to weakness at the tip. As such, the cutting edges 12 are slightly rounded off by creating a rounded cutting edge having a very small radius R, thereby significantly reducing these problems and creating greater stability at lower rotational speeds of the cutting tool 10. This process is known as "honing". Cutting edge honing increases the stability and reduces vibrations at low rotational speeds, as a result of damping enabled by increased contact of the cutting edge with the workpiece which accordingly slows down the vibrations. Precise and repeatable cutting edge honing is important for the stability and repeatability of the cutting operation in many different applications, particularly, for example, flank milling precise parts such as gas turbine compressors and turbine rotors. In such applications, inconsistent edge honing along the cutting edges of the cutting tool has been known to cause different deflections and blade thicknesses on critical parts.

Figure 2A:
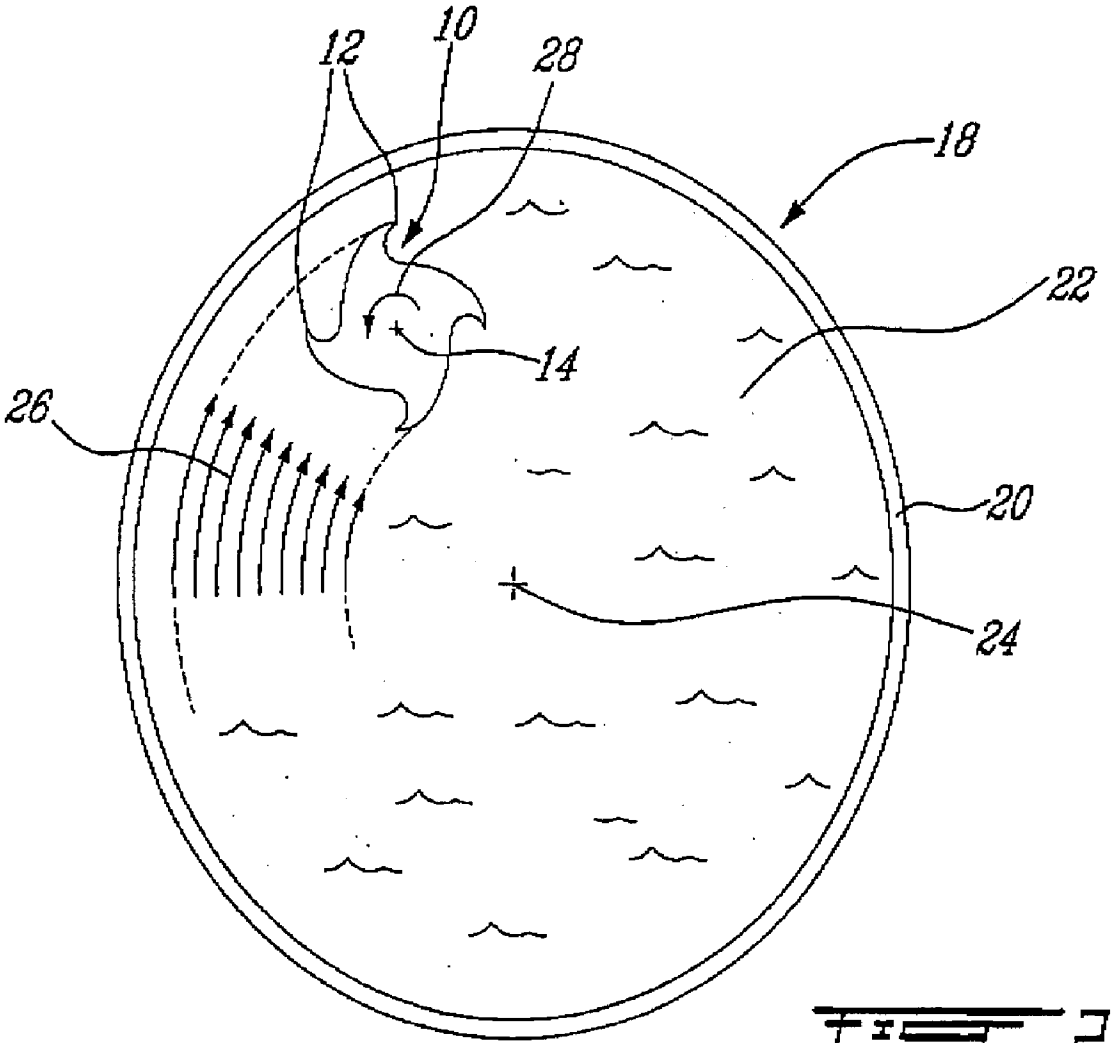
FIG. 2*a* is a top plan view of a cutting tool in a cutting edge honing bath in accordance with the present invention.
Figure 3:
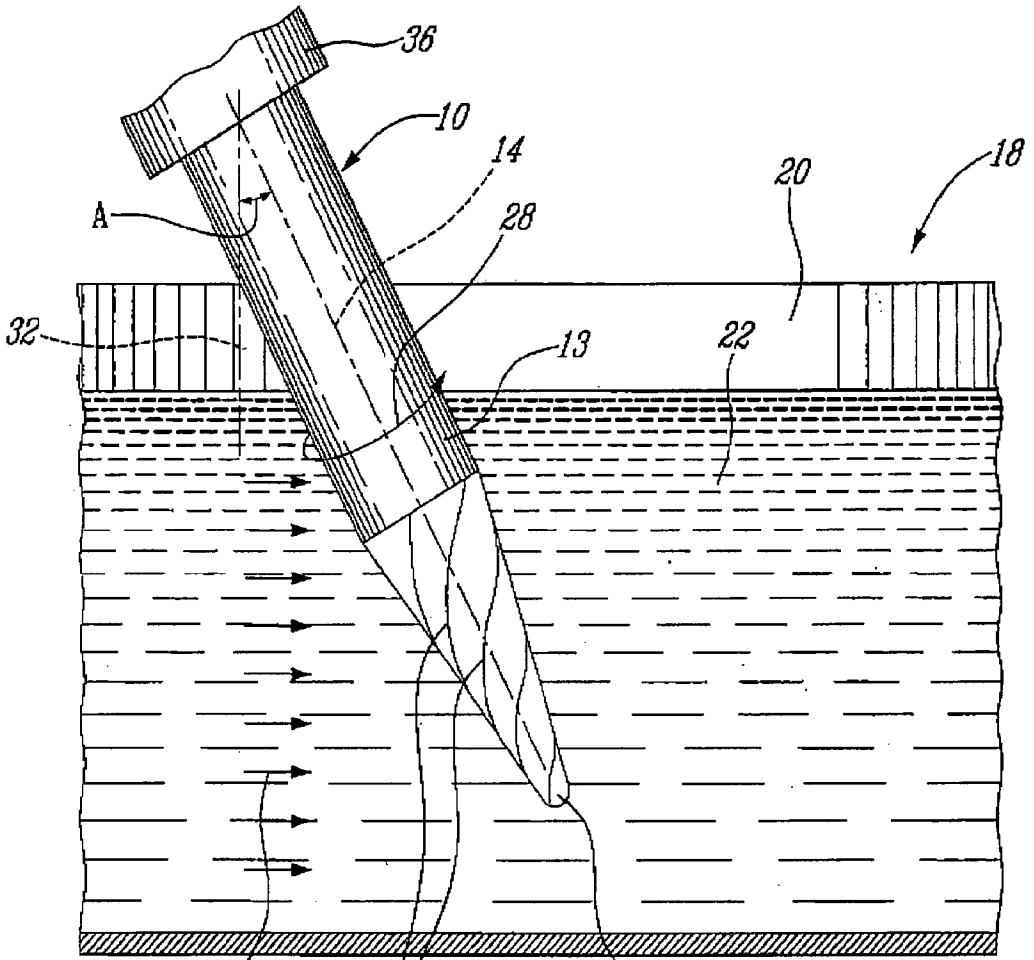
FIG. 3 is a partial side elevation view of the cutting tool in the cutting edge honing bath of FIG. 2*a*.

The cutting tool honing system and process of the present invention is depicted generally in FIGS. 2*a* and 3, in which the cutting tool 10 is immersed in a bath 18. The bath 18 comprises tub walls 20 which retain a liquid abrasive media mixture 22 therein. Although the bath 18 is depicted as a circular tub, it is to be understood that other shaped baths may be employed. The circular tub walls 20 define a central axis 24 of the bath. Preferably, the liquid abrasive media 22 is pumped through the bath such that it is circulated in a direction 26, the cutting tool 10 being inserted into the bath such that at least the cutting edges 12 thereof are completely immersed and disposed within the flow path 26 of the abrasive media 22. Preferably, the cutting tool is also rotated, while immersed in the abrasive media, in place about its own longitudinal central axis 14 in a direction 28, which is opposite to its cutting direction 16. Therefore, a relative displacement between the cutting tool and the liquid abrasive media mixture is provided such that the abrasive media flows over the cutting edges 12 and thereby honing them. Although the abrasive media is preferably circulated through the bath, the cutting tool may also, or alternately, be displaced within the bath, whether the abrasive media flow is being independently circulated in the bath or not, in a predetermined manner such as along a circular path about the central axis 24 of the bath. The cutting tool 10 may be displaced either in the same direction as the media flow 26 or opposite thereto, and the media flow velocity can be adjusted accordingly.

The abrasive media 22 preferably comprises very small abrasive granules within a liquid mixture including water and soap. However, other abrasive media mixtures can be employed provided the abrasive granules are small, such that a relative fine honing of the cutting edges 12 is enabled, and thus creating a very small and smooth radius along the full length of the cutting edges 12.

As seen in FIG. 3, the cutting tool 10 is preferably inserted into the abrasive media 22, which is flowing generally in direction 26, at an angle A relative to a vertical axis 32. Particularly, the cutting tool 10 is inclined relative to this vertical axis 32 such that an upper portion 13 of the cutting tool is located upstream relative to a lower tip portion 11 thereof. The angle A is preferably acute and is selected based on the characteristics of the particular cutting edges 12, namely considering angle, pitch, spacing, etc. This vertical inclination of the cutting tool 10 relative to the abrasive media flow 26, together with the rotation of the cutting tool in direction 28 about its longitudinal central axis 14 in a direction opposite to its cutting direction, allows for very smooth and repeatable honing along the full length of the cutting edges 12.

Figure 4:
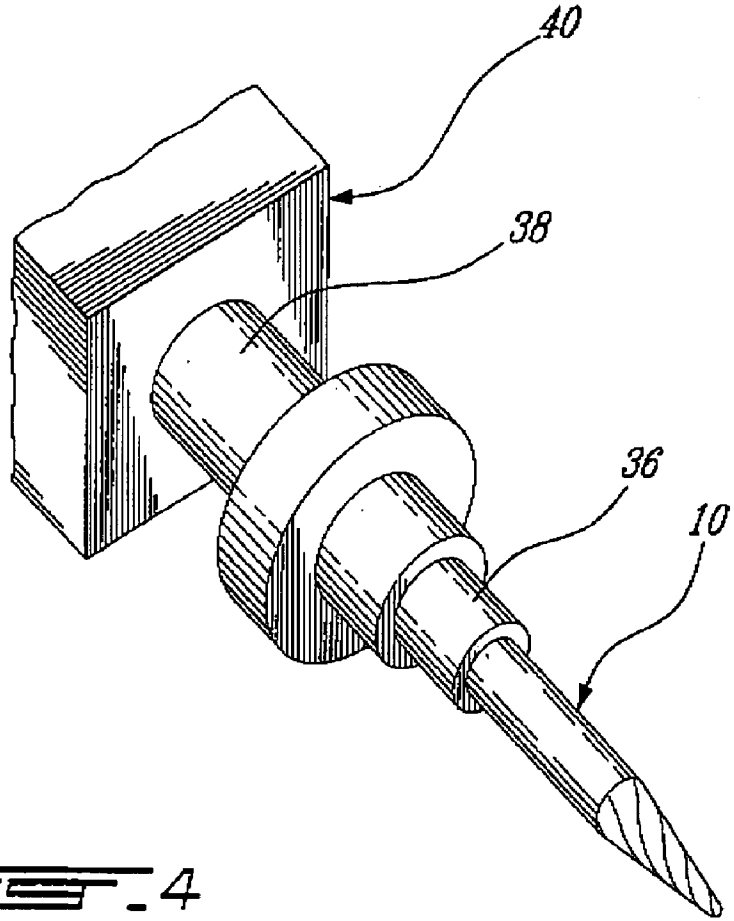
FIG. 4 is a perspective view of a cutting tool driven by a machine tool in accordance with a cutting edge honing system of the present invention.

As seen in FIGS. 3 and 4, the cutting edge honing system of the present invention also includes a cutting tool holder 36 which is adapted for engaging the cutting tool 10 and is operable to rotate the cutting tool in the direction 28 about its central axis 14, and to vertically displace such that the cutting tool is inserted and removed from the abrasive media bath 18 when desired. The cutting tool holder 36 may also be operable to displace the cutting tool within the bath. The cutting tool holder 36 is preferably engaged to a rotatable spindle 38 of a machine tool 40 which can be operated either manually, or numerically controlled by a CNC-type machine which is programmable to automate a predetermined displacement rotation, and/or immersion time of the cutting tool within the bath. The flow of abrasive media 22 is preferably produced by a flow producing means (not shown), such as a pump selected for use with a liquid having abrasive granules suspended therein.

The cutting edge honing process of the present invention is both time and cost effective, and requires significantly less operator skill and setup time than known honing processes. Further, the present cutting edge honing process provides reliable and repeatable edge honing which is easily controllable by adjusting easily varied parameters such as cutting tool rotation speed, and abrasive media flow speed and direction. The cutting edge honing process of the present application is also easily applicable to cutting tools of different types, such as end mills, inserts and helical milling cutters for example.

Figure 2B:
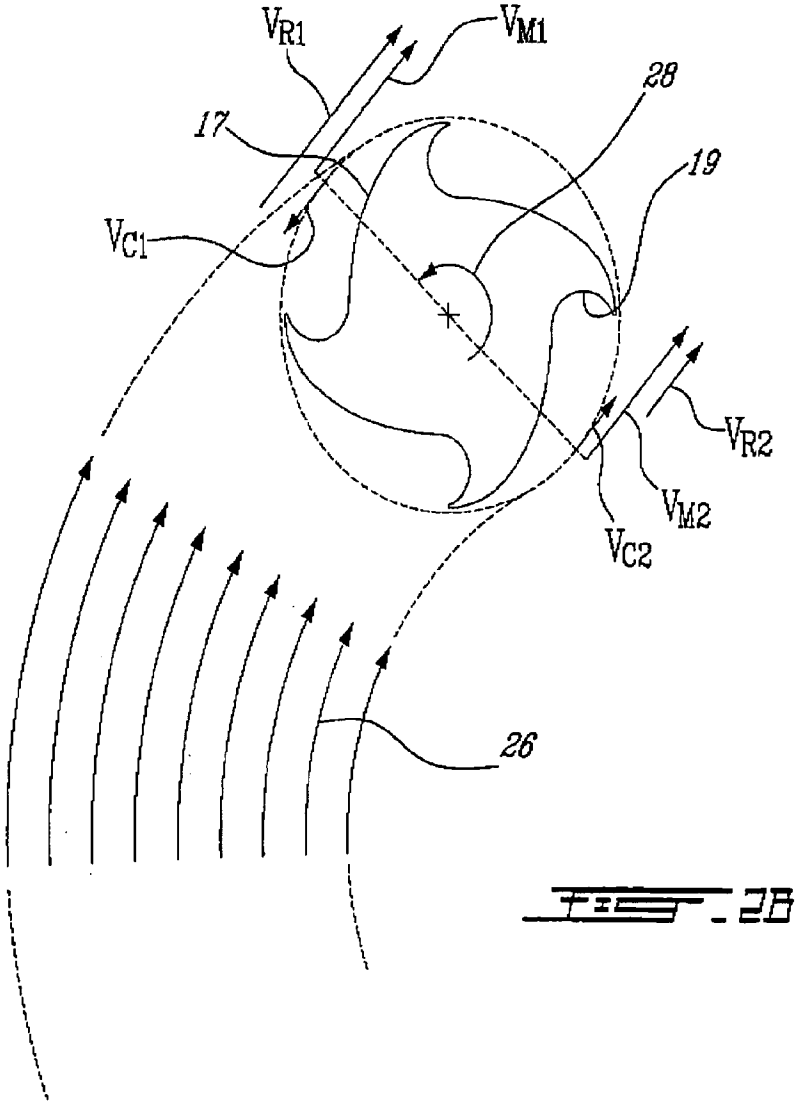
FIG. 2*b* is a more detailed top plan view of the cutting tool of FIG. 2*a;*

Referring to FIG. 2*b*, as a result of rotating the tool 10 in a direction 28 opposite to the cutting direction and placing it in media flow 26 which is circulated circumferentially within the bath 18, the small abrasive particles of the abrasive media flow impinge against the cutting tool 10 with a higher medial tangential speed ($V_{M1}$) on the clearance faces 17 thereof and a lower medial tangential speed ($V_{M2}$) on the rake faces 19 thereof. The tangential speed of the cutter as a result of its rotation is indicated in FIG. 2*b* by $V_{C1}$ and $V_{C2}$. The overall resultant tangential speed ($V_{R2}$) at the rake faces 19 is therefore less than the resultant tangential speed ($V_{R1}$) at the clearance faces 17. As a result, very smooth and repeatable honing along the full length of the cutting edges 12 is achieved by this embodiment.

The above description is meant to be exemplary only, and one skilled in the art will recognize that changes may be made to the embodiments described without department from the scope of the invention disclosed. For example, the abrasive media mixture may be composed of different sizes and varieties of abrasive particles, within a liquid with may be water or any other suitable liquid which can be readily circulated in the bath as necessary. Further, shapes and configurations of abrasive media baths other than that described and depicted can be used. Various relative flow circulation and cutting tool displacement patterns may also be employed to hone the cutting edges of the cutting tool immersed in the abrasive media bath. One skilled in the art will also understand that the length of time required in the abrasive media bath, along with the specific flow velocity, cutting tool rotational speed and other operational characteristics of the system, will depend on the cutting tool material and type, and the amount of cutting edge honing required for the particular tool application. Still other modifications which fall within the scope of the present invention will be apparent to those skilled in the art, in light of a review of this disclosure, and such modifications are intended to fall within the appended claims.

The invention claimed is:

1. A method of honing cutting edges of a rotary cutting tool having an upper tool portion, a tip portion and the cutting edges at least partially therebetween, the method comprising inserting the cutting tool into a liquid bath having an abrasive media therein such that at least the cutting edges are immersed;

orienting the cutting tool within the bath at an angle relative to a vertical axis;

providing a relative displacement of the cutting tool and the liquid bath such that the abrasive media flows over the cutting edges; and selecting the angle of the cutting tool such that the upper tool portion is upstream of the tip portion relative to a direction of the relative displacement.

2. The method as defined in claim 1, further comprising rotating the cutting tool about a central axis thereof within the liquid bath.

3. The method as defined in claim 2, further comprising rotating the cutting tool in a direction opposite to a cutting direction thereof.

4. The method as defined in claim 1, further comprising providing a flow of liquid within the liquid bath which impinges against the cutting tool.

5. The method as defined in claim 1, further comprising moving the cutting tool within the liquid bath.

6. The method as defined in claim 5, further comprising producing a flow within the liquid bath and moving the cutting tool in a direction opposite to the flow.

7. The method as defined in claim 6, further comprising moving the cutting tool along circular path within the liquid bath about a vertical axis of the liquid bath.

8. The method as defined in claim 1, further comprising using a numerically controlled machine tool, within which the cutting tool is mounted, to move the cutting tool, and programming said numerically controlled machine tool to displace the cutting tool through a predetermined path within the bath.

9. A cutting tool honing system for a rotary cutting tool having an upper tool portion, a tip portion and cutting edges at least partially therebetween, the system comprising:

a liquid bath within which the cutting tool is receivable, the bath including an abrasive granular media therein;

a cutting tool holder adapted for engaging the cutting tool, the cutting tool holder being operable to rotate the cutting tool about a central axis thereof;

a means for producing a relative displacement between the cutting tool and the liquid bath, such that a relative flow of the liquid bath over the cutting edges of the cutting tool hones said cutting edges; and wherein the central axis is oriented an angle relative to a vertical axis such that the upper tool portion of the cutting tool is upstream of the tip portion thereof relative to the relative flow of liquid bath over the cutting edges.

10. The cutting tool honing system as defined in claim 9, wherein the cutting tool holder is engaged to a spindle of a machine tool, the spindle being rotatable to rotate the cutting tool about the central axis and horizontally displaceable to displace the cutting tool within the bath.

11. The cutting tool honing system as defined in claim 10, wherein the spindle is vertically displaceable, such that the cutting tool engaged therein is insertable into, and removable from, the bath.

12. The cutting tool honing system as defined in claim 10, wherein the machine tool is numerically controlled, and is programmable to displace the cutting tool engaged within the spindle thereof through a predetermined path within the bath.

13. The cutting tool honing system as defined in claim 12, wherein the predetermined path is configured relative to a direction of the flow within the bath.

14. The cutting tool honing system as defined in claim 9, wherein a forced flow within the bath is generated by a flow producing means.

15. The cutting tool honing system as defined in claim 14, wherein the flow producing means is a pump.

16. A cutting edge honing process for a rotary cutting tool having an upper tool portion, a tip portion and cutting edges at least partially therebetween, the process comprising:

inserting the cutting tool into a liquid abrasive media bath such that at least the cutting edges are immersed;

orienting the cutting tool within the abrasive media bath at an angle relative to a vertical axis;

rotating the cutting tool about a central axis thereof within the abrasive media bath;

providing a relative displacement of the cutting tool and the liquid abrasive media bath; and selecting the angle such that the upper tool portion of the cutting tool is upstream of the tip portion thereof relative to a direction of the relative displacement.

17. The process as defined in claim 16, further comprising using a numerically controlled machine tool, within which the cutting tool is mounted, to move the cutting tool, and programming said numerically controlled machine tool to displace the cutting tool through a predetermined path within the bath.

* * * * *